United States Patent [19]

Houk, deceased

[11] Patent Number: 4,725,933

[45] Date of Patent: Feb. 16, 1988

[54] LINE GUIDE PROJECTOR

[75] Inventor: Richard D. Houk, deceased, late of Summit County, Ohio, by Suzan Joy Houk, executor

[73] Assignee: Fairway International, Inc., Kent, Ohio

[21] Appl. No.: 906,312

[22] Filed: Sep. 11, 1986

[51] Int. Cl.[4] ..... F21V 21/28; F21V 19/02

[52] U.S. Cl. ..... 362/287; 362/269; 362/275; 362/289; 362/372

[58] Field of Search ..... 362/220, 222, 225, 275, 362/269, 287, 289, 372, 429, 430

[56] References Cited

U.S. PATENT DOCUMENTS

| | | | |
|---|---|---|---|
| 2,595,011 | 4/1952 | Singer | 362/269 |
| 4,322,783 | 3/1982 | Chappell | 362/225 |
| 4,454,569 | 6/1984 | Maguire | 362/269 |
| 4,639,838 | 1/1987 | Kato | 362/287 |

*Primary Examiner*—Douglas Hart

*Attorney, Agent, or Firm*—Renner, Kenner, Greive, Bobak & Taylor

[57] ABSTRACT

A line projector (10) embodying the concepts of the present invention is employed to project a vane of light onto a work surface (16). The line projector is contained within a housing (12) that is mounted, as on the truss arrangement (13), in spaced relation from the work surface (16). The structure by which the housing (12) is supported may include a fixed connector assembly (52) or an adjustably movable carriage connector (70) by which to effect in gross movement of the line projector (10) along the supporting truss (13). A lamp (100) having a linear filament (122) is mounted within the housing (12), and it is the image of the filament (122) that is projected as the vane of light onto the work surface (16). A particularly unique pedestal arrangement (140) is employed demountably to support the lamp (100) as well as selectively to translate and/or skew the lamp relative to the housing (12).

22 Claims, 10 Drawing Figures

LINE GUIDE PROJECTOR

TECHNICAL FIELD

The present invention relates generally to line projectors. More particularly, the present invention relates to a projector whereby the image of a lamp filament is itself projected onto a work surface as a vane of light. Specifically, the present invention is directed to a projector whereby the image of the lamp filament is capable of being projected onto a non planar work surface as successfully as onto a planar work surface, the projector being provided not only with means selectively to locate the projector housing relative to the work surface but also with means whereby accurately to adjust the disposition of the lamp filament relative to the projector housing in order to obtain the required, precise orientation of the filament relative to the work surface necessary to achieve the requisite alignment of the image onto the work surface.

BACKGROUND ART

The projection of the image of a lamp filament onto a work surface as a vane of light in order to delineate a guide line on the work surface is not new to the art. Filament image projection probably had its genesis when artists desired to determine the intersection of a plane with a curved surface. Typically, when a beginning artist attempted to draw the human figure it was difficult for the neophyte's eye initially to determine what portion of the curved body lay in any given plane. Thus, the first line projector was employed. However, there was no need for absolute accuracy, nor did it matter that the image of the filament may not have been absolutely sharp.

The use of line projectors is particularly desirable in those situations where it is either impossible, or undesirable, to strike a reference line on the work surface itself. For example, in the manufacture of automotive tires it is not only time consuming to strike an accurate, thin, highly visible reference line on the tire building drum, as well as each of the multiple layers of material wound thereon during the manufacturing process, but the dark material used in the manufacture of tires can make such a reference line quite difficult to see. In addition, the introduction of chalk, or other marking material, as a reference line can contaminate the work surface. Thus, the use of a line projector can obviate a number of problems and be quite suitable for many manufacturing operations.

As industrial applications for the use of line projectors evolved, distortion, multiple imaging and even minor misalignment could not be tolerated, and over the years a variety of rather complicated arrangements were devised whereby to adjust the orientation of the projector itself in order to attempt to effect the desired alignment of the projected image. Even though considerable strides were made in effecting a desired depth of field to the projected image—in order to accommodate non planar surfaces—as well as in eliminating double, or ghost, imaging, the means by which to adjust the orientation of the projected filament image remained quite complicated. The problem of achieving the desired orientation of the filament image was particularly complicated by the fact that even with rather rigid quality control it is quite difficult to obtain consistent orientation of the filament within the glass envelope from lamp to lamp. This problem is considerably compounded as the length of the filament is increased.

This problem can, perhaps, be most readily appreciated when one considers that an inordinate amount of time and patience was required to achieve the desired orientation of the projected filament image onto the work surface with prior art projectors. Moreover, after the desired orientation of the prior art projector had been achieved it could all be for naught when the lamp burned out and had to be replaced, because the orientation of the filament in the replacement lamp would assuredly not be the same as it had been in the previous lamp.

DISCLOSURE OF THE INVENTION

It is, therefore, a primary object of the present invention to provide a line projector that can be readily, and easily, adjusted.

It is a further object of the present invention to provide a line projector, as above, whereby the disposition of the lamp filament relative to the disposition of the projector housing can be accurately and easily adjusted, even with a lamp having a relatively long filament.

It is another object of the present invention to provide a line projector, as above, whereby the disposition of the projector housing relative to the work surface can be accurately adjusted, also with accuracy and comparative ease.

It is yet another object of the present invention to provide a line projector, as above, whereby the position of the line projector housing can be adjusted longitudinally along a supporting beam and a lamp mounted in the housing of the projector may be laterally adjusted and/or skewed relative to the projector housing and independently of the position of the projector housing along the supporting beam.

It is a still further object of the present invention to provide a line projector, as above, in which the lamp can be replaced with considerable ease and without affecting the disposition of the projector housing relative to the supporting beam.

It is an even further object of the present invention to provide a line projector, as above, that incorporates means for effecting facile adjustment of the image projected from the lamp by relatively uncomplicated lateral translation and/or skew adjustment to the disposition of the lamp, and thus the lamp filament, relative to the projector housing.

These and other objects of the invention, as well as the advantages thereof over existing and prior art forms, which will be apparent in view of the following specification, are accomplished by means hereinafter described and claimed.

In general, a line projector embodying the concepts of the present invention is employed to project a vane of light onto a work surface. The line projector is incorporated in a housing that is mounted in spaced relation relative to the work surface, and the structure by which the housing is mounted generally includes means by which to adjust the position of the projector housing longitudinally parallel to a reference axis for the work surface.

A lamp having a linear filament is mounted within the housing, and it is the image of the filament that is projected onto the work surface. Unique means are provided whereby not only demountably to secure the lamp within the housing but also selectively to translate and/or skew the lamp within, and relative to, the housing.

An exemplary embodiment of a line projector incorporating the concepts of the present invention is disclosed herein by way of example without attempting to show all of the various forms and modifications in which the invention may be employed; the invention being measured by the appended claims and not by the details of the specification.

DESCRIPTION OF AN EXEMPLARY EMBODIMENT

Figure 1:
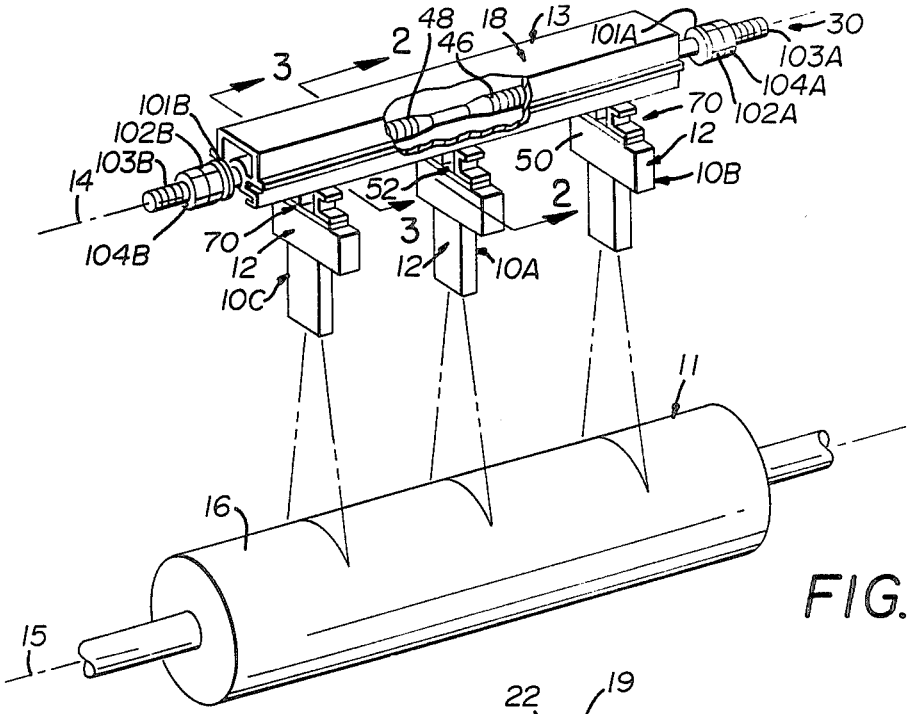
FIG. 1 is a schematic perspective depicting a plurality of improved line projectors embodying the concepts of the present invention mounted on a unique supporting truss, consisting of at least one beam, to project a vane of light produced by the image of the filament in the lamp within the projector housing as a sharp image even on a non planar work surface, such as a tire building drum.

A line projector embodying the concepts of the present invention is designated generally by the numeral 10 on the attached drawings. With reference to FIG. 1 a plurality of line projectors 10A, 10B and 10C may be advantageously employed to project an equal number of lines onto a tire building drum 11. In such an arrangement the housing 12 of each line projector 10 is selectively positional longitudinally along a supporting truss 13 that is rigidly secured above the tire building drum 11. Some considerable attention should be given to the initial installation of the supporting truss 13 inasmuch as proper orientation of the supporting truss 13 will assure that the full capabilities of the improved line projector 10 are achieved.

Specifically, attention should be given to assure that the longitudinal axis 14 of the truss 13 is disposed parallel to the reference axis 15 of the work surface 16. When the work surface 16 constitutes the generally cylindrical surface of a tire building drum 11, the reference axis 15 of the work surface is the axis of the drum 11. For other work surface configurations the reference axis will become apparent from an understanding of the invention.

The supporting truss 13 may comprise one or more beams 18. In FIG. 1 a single beam 18 is depicted, and in FIG. 1A a pair of beams 18A and 18B are employed. With particular reference to the details of FIG. 3, it can be seen that each beam 18 has a boxed portion 19 that it primarily responsible for the bending, shear and torsional strength of the beam 18. The boxed portion 19 has planar side walls 20 and 21 that are disposed in laterally spaced relation and are interconnected by a top wall 22 and a bottom member 25. The bottom member 25 of the boxed portion 19 has an elaborately shaped cross section which contributes to its ability to achieve the desired functional results required of each beam 18.

One component in the elaborate cross sectional configuration of the bottom member 25 constitutes a cylindrically hollow casing 26 that extends the full longitudinal extent of the bottom member 25 to receive, and support, an adjusting spindle 30 for rotational movement. A first wing wall 31 extends radially outwardly from the exterior of casing 26 perpendicularly to intersect the side wall 20. The first wing wall 31 also extends beyond the side wall 20 to present a transversely oriented, locating rib 32 that may preferably extend the full longitudinal length of the beam 18.

Figure 1A:
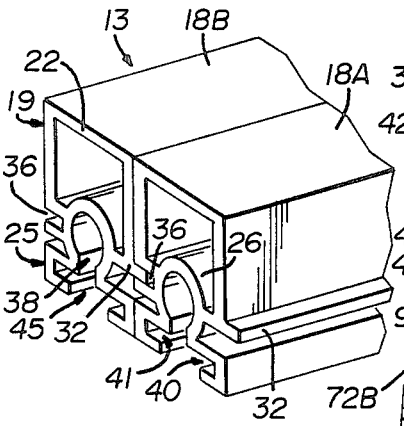
FIG. 1A is an enlarged perspective of one end of a supporting truss that incorporates a pair of beams of the type depicted in FIG. 1, said beams being structurally interengaged as a composite truss.

A pair of parallel, vertically spaced, second wing walls 33 and 34 also extend outwardly from the exterior of the casing 23, but in substantially diametric opposition to the first wing wall 31. The uppermost wall 33 of the two second wing walls 33 and 34 intersects with, and terminates at, the side wall 21. The other wing wall 34 of the parallel, second wing walls 33 and 34 extends outwardly from the exterior of the cylindrical casing 26 no further than the plane of the outer surface 35 on side wall 21. The wing wall 34 is spaced below the wing wall 33 a distance equal to the vertical thickness of the opposite wing wall 31 in order to define a locating recess 36 between the wing walls 33 and 34. The provision of locating ribs 32 and recesses 36 permits a plurality of adjacent beams, such as 18A and 18B, to be laterally interconnected as a composite supporting truss 13, as depicted in FIG. 1A.

Another component of the elaborate bottom member 25 comprises the inner access aperture 38 that opens vertically downwardly through, and preferably extends the full longitudinal extent of, the casing 26. The function of the inner access aperture 38 will be hereinafter more full apparent.

A third component of the elaborate bottom member 25 comprises a pair of opposed slideways 40 and 41. The slideways 40 and 41 are each formed by virtue of upper walls 42A and 42B, respectively, that extend transversely outwardly from the opposite sides of the inner access aperture 38 and lower walls 43A and 43B that lie in parallel, spaced relation beneath the upper walls 42A and 42B. The laterally outer ends of the walls 42 and 43 are connected, one to the other, vertical web walls 44A and 44B, but the opposed inner ends of the lower walls 43A and 43B are laterally spaced to define an outer access aperture 45. The criteria by which most effectively to select the dimensions for the slideways 40 and 41 as well as the access apertures 38 and 45 will hereinafter become apparent.

The outermost circumference of the adjusting spindle 30 is provided with longitudinally spaced, threaded sections 46 and 48 (FIG. 1) that are preferably of opposite hand for a purpose more fully hereinafter described. In order to enhance the rotational capability of the spindle, and to minimize backlash of the components to be driven by the spindle 30, the threaded sections 46 and 48 may be formed as rolled acme threads.

With reference to FIGS. 2, 4, 5 and 6, the housing 12 of each line projector 10 is preferably provided with a cap portion 50 that is demountably secured to the body portion 51 of the housing 12, and the cap portion 50 is suspended from an appropriate beam 18 in the supporting truss 13. For some installations it may be desirable fixedly to secure the line projector 10 at a particular location along the length of a beam 18, such as is represented by the middle line projector 10A in FIG. 1.

Figure 2:
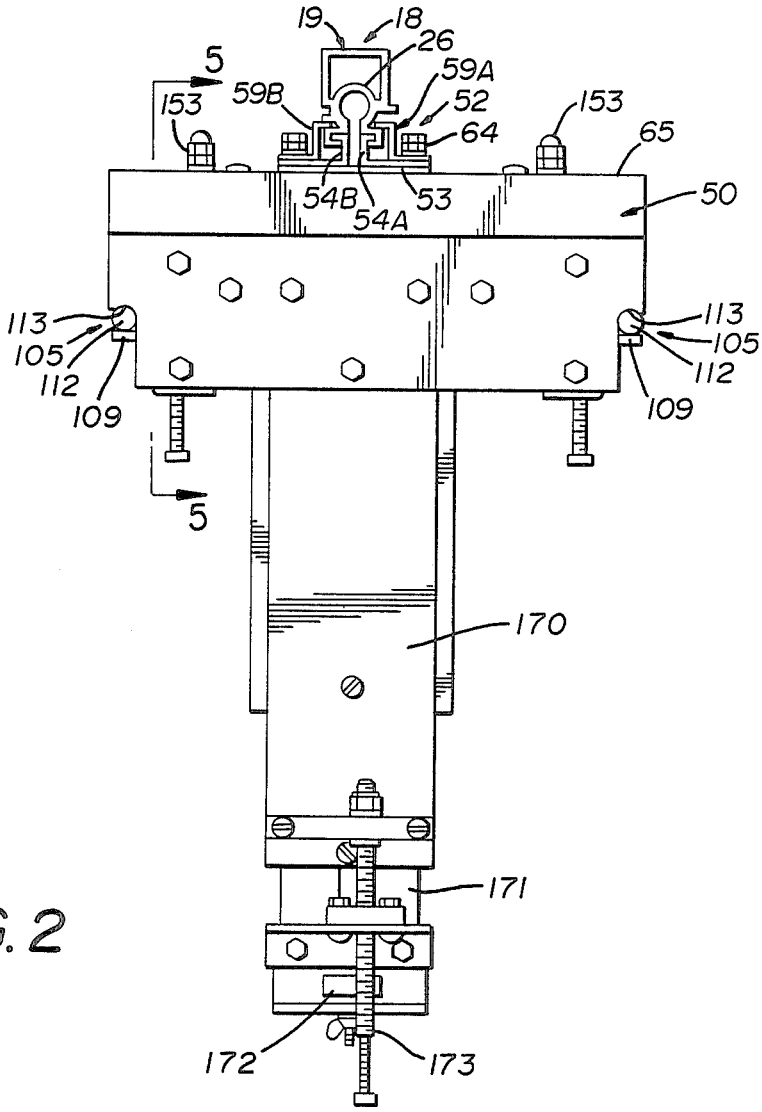
FIG. 2 is an enlarged side elevation of an improved line projector, adapted to be supported from a beam by virtue of a fixed connector assembly, and taken substantially along line 2—2 of FIG. 1.
Figure 8:
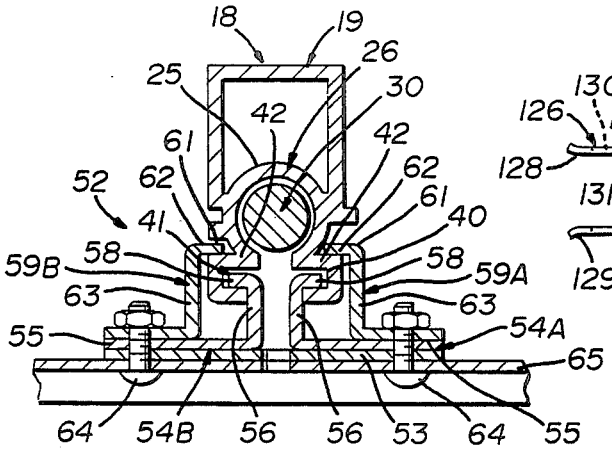
FIG. 8 is an enlarged area of FIG. 2 depicting the fixed connector assembly in end elevation.

When the line projector 10A is to be secured in a relatively immobilized manner relative to a beam 18, a fixed connector assembly 52 may be employed. As is best seen in FIGS. 2 and 8, a fixed connector assembly 52 may employ a base plate 53 that interconnects with a plurality of flange plates. Included among the flange plates so employed are a pair of J-shaped, hook plates 54A and 54B. Each plate 54 has a flat body portion 55 that overlies the base plate 53. An extension arm 56 extends upwardly from the body portion 55 and terminates in a hook 58 that lies in spaced relation upwardly of the body portion. The hook 58 on plate 54A firmly engages the slideway 40, and the corresponding hook 58 on plate 54B firmly engages the slideway 41.

Also included among the flange plates so employed are a pair of generally Z-shaped, strap plates 59A and 59B. The strap plates 59A and 59B each have a connector flange 60 that overlie the body portion 55 of the hook plates 54A and 54B as well as the base plate 53. Each strap plate 59 also has a securing flange 61 that firmly engages the upwardly directed surface 62 on the appropriate upper wall 42 that defines the slideways 40 and 41. A generally vertically oriented web 63 extends between the connector flange 60 and the securing flange 61.

The aforesaid flange plates 54 and strap plates 59, as well as the base plate 53, may be secured to the horizontal cover plate 65 of the cap portion 50 by a plurality of nut and bolt combinations 64. It is quite important that the projector housing 12 be firmly secured in place on the beam 18. As such, it is strongly recommended that the hooks 58 on the J-shaped plates 54 closely fit within the slideways 40 and 41, and that the extension arms 56 also firmly engage the opposed ends of the respective lower walls 43. In that way the projector housing 12 will be rigidly located when the nut and bolt combinations 64 tighten the plates 54 and 59 against the surfaces of the bottom member 25 engaged thereby.

Figure 3:
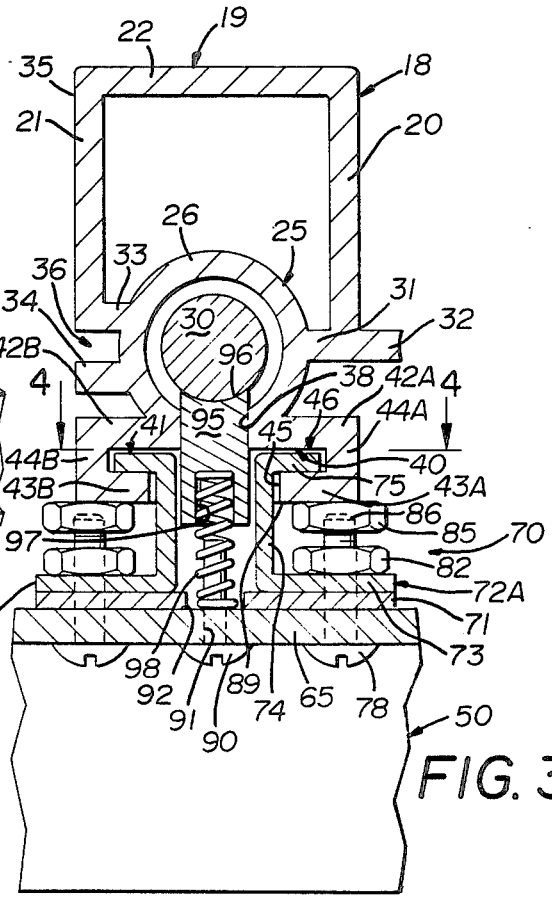
FIG. 3 is an enlarged cross section taken substantially along line 3—3 of FIG. 1 and depicting a carriage type connector assembly by which a line projector housing may be moved longitudinally along a support beam, FIG. 3 appearing on the same sheet of drawings as FIG. 1.
Figure 4:
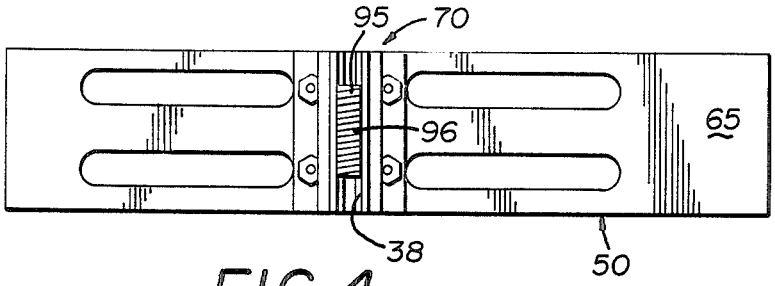
FIG. 4 is a transverse section taken substantially along line 4—4 of FIG. 3 to depict the cap portion of the housing, as well as a carriage type connector assembly, in top plan, FIG. 4 appearing on the same sheet of drawings as FIG. 2.

When the location of a line projector 10 is to be selectively adjusted along a beam 18, as are projectors 10B and 10C in FIG. 1, a carriage connector 70 may be advantageously employed. Referring particularly to FIG. 3 a carriage connector 70 may employ a base plate 71 that supports a pair of J-shaped, hook plates 72A and 72B. Each plate 72 has a flat body portion 73 that overlies the base plate 71. An extension arm 74 extends upwardly from the body portion 73 and terminates in a hook 75 that lies in spaced relation upwardly of the body portion 73. The hook 75 on plate 72A is adapted firmly to engage the slideway 40, and the corresponding hook 75 on plate 72B is similarly adapted firmly to engage the slideway 41. A plurality, preferably two spaced pairs, of bolts 78 extend upwardly through registered bores 79, in the horizontal cover plate 65 of the cap portion 50, bores 80, in the base plate 71, and bores 81, in the body portion 73 of the hook plates 72A and 72B. A first nut 82 is tightened onto each bolt 78 rigidly secure the base plate 71 and the J-shaped hook plates 72A and 72B to horizontal cover plate 65 of the cap portion 50.

A second nut 85 is also mounted on each bolt 78. The length of the bolts is selected so that the ends 86 thereof will not engage the lower walls 43A and 43B when the heads 88 are firmly engaged with the horizontal cover plate 65 on the cap portion 50. And yet the bolts are of sufficient length that the nuts 85 may be "backed off" firmly to engage the downwardly directed surfaces 89 on the lower walls 43A and 43B. The nuts 85 are preferably fabricated from a material, such as nylon, which has a relatively low coefficient of friction so that they will be capable of sliding along the surfaces 89 even when they have been backed off sufficiently to effected a firm contact between the hooks 75 and the corresponding slideways 40 and 41 in which the hooks 75 are received.

Engagement of the nuts 85 with the surfaces 89 also imparts stability to the projector 10 by precluding the cap 50 from rocking relative to the support beam 18.

A plurality of guide bolts 90 extend upwardly through registered bores 91, in the horizontal cover plate 65, and bores 92, in the base plate 71, to support the biasing means which acts continuously upon the follower block 95. The vertically uppermost surface of the follower block 95 presents threads 96 that matingly engage either the threaded portions 46 or 48 on spindle 30. A compression spring 98 circumscribes each guide bolt 90 and acts between the base plate 71 and the blind bore 97 in the underside of the follower block 95 to bias the threads 96 on block 95 firmly into engagement with the appropriate threaded portions 46 or 48 on the spindle 30.

The outer diameter of the threaded portions 46 and 48 on the spindle 30 are such that the spindle 30 is supported for rotation within the casing 26. Rotation of the spindle 30 may be selectively precluded by a friction brake in the form of washers 101A and 101B (FIG. 1), one at each end of the spindle 30, that may be pressed firmly into engagement with the corresponding end of the casing 26 by first nuts 102A and 102B carried on the threaded ends 103A and 103B, respectively, of the spindle 30. Second, or lock, nuts 104A and 104B are also carried on the respective threaded ends 103A and 103B of the spindle 30 in order to secure the position of the first nuts 102A and 102B.

By making the threaded portions 46 and 48 of opposite hand selective rotation of the spindle 30 will simultaneously move the line projectors 10B and 10C, as depicted in FIG. 1, toward and away from each other. In order to move the line projectors 10B and 10C one must release at least one of the lock nuts 104 and then loosen at least the first nut 102 (adjacent the lock nut so released) sufficiently to permit the spindle 30 to be rotated within the casing 26. Once the projectors 10B and 10C are appropriately positioned, the first nuts 102 are tightened to drive the washers 101A and 101B into firm frictional engagement with the ends of the casing 26. This precludes further rotation of the spindle 30, and that result can be maintained by tightening the appropriate lock nuts 104 against the respective first nuts 102.

At this point one can appreciate that by employing a second beam 18B (as depicted in FIG. 1A) one can readily provide additional line projectors for operation in conjunction with the same work surface 16 as the projectors mounted on beam 18A, or, for that matter, on adjacent, but compatible, work surfaces. A little advanced planning will assure that the projectors on the two beams 18A and 18B will not interfere.

Figure 6:
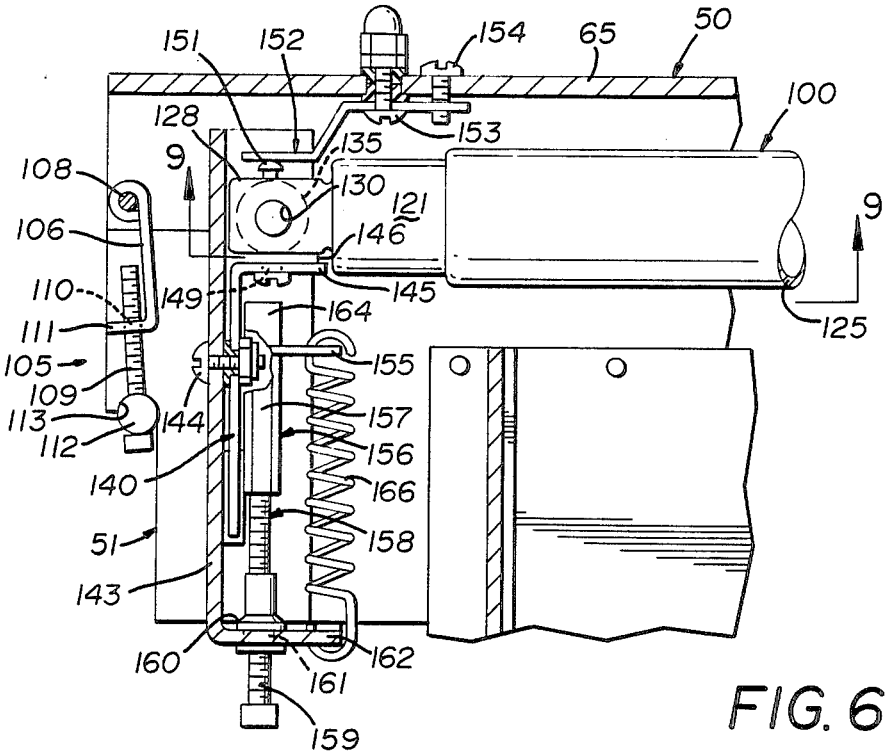
FIG. 6 is a further enlarged vertical section, but taken substantially along line 6—6 of FIG. 5, and depicting the mechanism, in side elevation, by which the lamp may be translated laterally and/or skewed relative to the projector housing.

As is perhaps best seen from FIGS. 2 and 6, the body portion 51 of the projector housing 12 is demountably secured to a cap portion 50. Hence, when one has a cap portion 50 properly oriented on a beam 18 at a first work station there is no need to remove the entire line projector 10 when it is required at another work station. Rather, one may simply remove the body portion 51 from the cap portion 50 secured at the first work station and attach that body portion 51 to another cap portion 50 at the other work station. The line projector 10 has also been conceived so that the facile means for demountably securing a body portion 51 to various cap portions 50 is also employed to gain access to the interior of the housing in order to change projector lamps.

The body portion 51 of a line projector 10 housing 12 may be conveniently fabricated in a T-shaped configuration, as best seen in FIG. 2. The upper, wider portion of the body 51 houses the incandescent lamp 100, the mechanism by which lateral translation and/or skewing of the lamp 100 is effected relative to the housing 12 as well as the quick connect mechanism 105 between the cap and body portions 50 and 51, respectively.

Turning first to the description of a quick connect mechanism 105 that may be provided at each end of the cap portion 50, a bracket 106 is pivotally supported from the cap 50, as by a pivot pin 108. A threaded tightening screw 109 is received within a bore 110 through a cross member 111 of bracket 106, and the screw 109 carries a lock bolt 112 that is engageable within a locking recess 113 on the side plates 114 and 115 of the body portion 51. As such, tightening the screw 109 will secure the lock bolt 112 within the recess 113 in order to fasten the body portion 51 to the cap portion 50, and conversely, loosening the screw 109 will allow the lock bolt 112 to swing clear of the recess 113 and thereby permit the body portion 51 to be rather easily demounted from the cap portion 50.

The means by which to secure, and adjust, the incandescent lamp 100 within the body portion 51 of the housing 12 is perhaps best described in conjunction with a description of the lamp 100.

Figure 9:
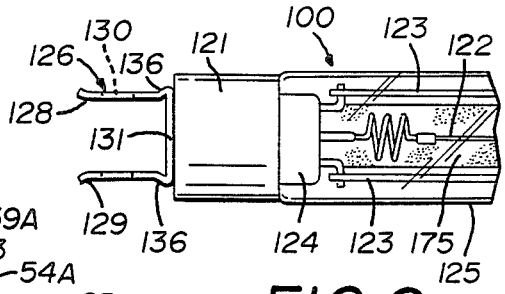
FIG. 9 is a section taken substantially along line 9—9 of FIG. 6 depicting the lamp in bottom plan; and, FIG. 10 is a schematic representation depicting how the translational and skew adjustments of the lamp effect the projection of the lamp filament onto a work surface.
Figure 10:
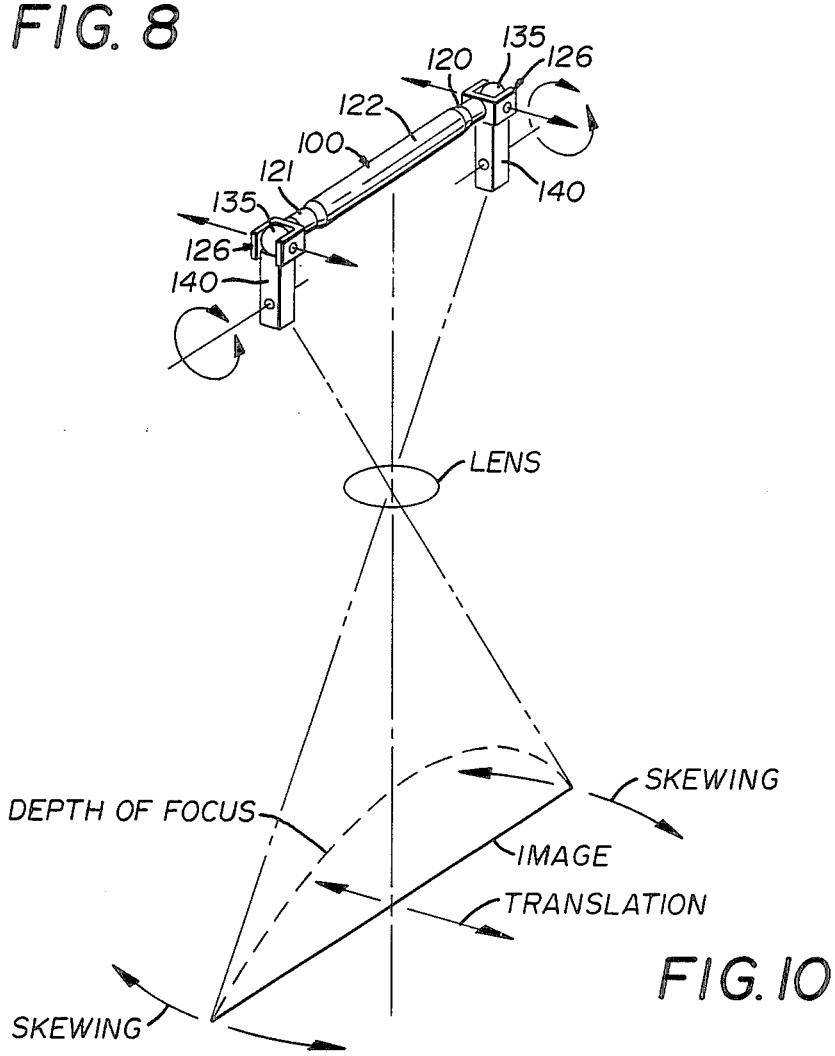

Accordingly, the lamp 100 has a pair of spaced bases 120 and 121 (FIG. 10), each of which comprises one of the pole connections for supplying electric service to the linear filament 122 (FIG. 9) that extends therebetween. Structural integrity may be provided to the lamp by the use of one or more support bars 123 that extend between the core portion 124 in each base 120 and 121. A cylindrical glass envelope 125 is sealed to each base 120 and 121 and extends therebetween to encase the support bars 123 as well as the filament 122.

A spring clip 126 is attached to each base 120 and 121. Each clip 126 comprises a pair of parallel, laterally spaced, fingers 128 and 129 that extend axially outwardly from the base 120 or 121 to which the clip 126 is mounted. Each finger 128 and 129 is transversely bored, as at 130, to accomplish a pivotal engagement between the clip 126 and the diametrically opposed sides of a spherical support ball 135. The connector arm 131 that extends between, and joins, the fingers comprises the mounting platform by which each clip 126 is secured to the appropriate base 120 or 121.

In order to assure that the lamp 100 will be able to accommodate a modest difference in the dimensional span between the mounting balls 135 that support the longitudinally spaced bases 120 and 121, as will exist as the lamp 100 is skewed by virtue of the hereinafter described pedestal mechanism 140, it has been found desirable that the spring clips 126 expand and contract, longitudinally, as necessary. One structural arrangement that effects this result comprises the use of an inclined offset 136 by which to join each finger 128 and 129 to the connector arm 131. The offset 136 permits each finger 128 and 129 to extend outwardly of, and to retract with respect to, the connector arm 131, thus accommodating any dimensional variation between the support balls 135 that might be experienced during the hereinafter described skewing adjustment.

Figure 5:
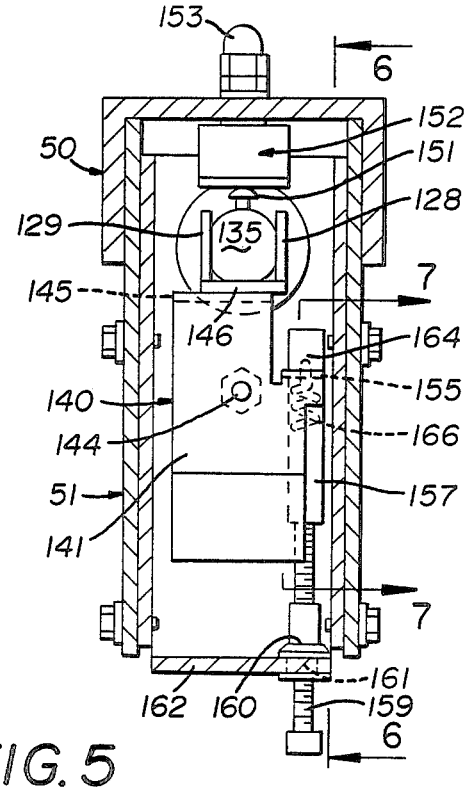
FIG. 5 is an enlarged vertical section taken substantially along line 5—5 of of FIG. 2 and depicting the mechanism, in end elevation, by which the lamp, and thus the filament within the lamp, may be translated laterally of itsel and/or skewed relative to the projector housing.
Figure 7:
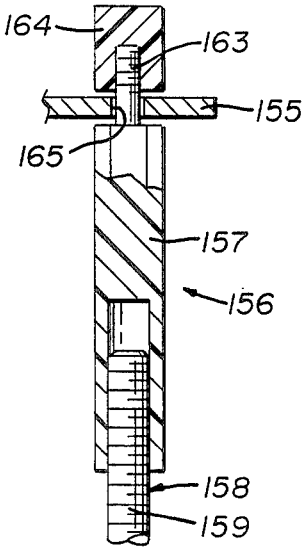
FIG. 7 is a still further enlarged vertical section taken substantially along line 7—7 of FIG. 5.

As is best seen from FIGS. 5 and 6, each support ball 135 is carried on a pedestal 140. The pedestal 140 has a frame plate 141 that is pivotally mounted on the end wall 143 on the wider portion of the housing body 51, as by a nut and bolt arrangement 144. A shelf 145 extends perpendicularly outwardly from the frame plate 141, and the support ball 135 is mounted on the shelf 145 but is preferably insulated electrically therefrom. Any number of approaches may be employed to effect the desired insulation, but as shown an insulating washer 146 may be interposed between the support ball 135 and the shelf 145 and an insulating bolt 148 (such as one fabricated from nylon) may extend through an appropriate bore 149 in the shelf 145 and then through the washer 146 to be threadably received within a mating bore, not shown, in the support ball 135. As shown, a contact extension 151 in the form of an electrically conductive screw may extend vertically upwardly from the support ball 135 to facilitate engagement with the appropriate spring contact 152. The spring contact 152 may be secured to the horizontal cover plate 65 of the cap portion 50 by a well known insulated nut and bolt arrangement 153 that also serves as the terminal by which to supply electric power to the lamp 100. A non conductive aligning pin in the form of a nylon machine bolt 154 may also extend through the cover plate 65 in the cap portion 50 to engage the contact 152 and thereby preclude it from turning about the nut and bolt arrangement 153.

A lever arm 155 also extends perpendicularly outwardly from the frame plate 141. Whereas the shelf 145 is preferably located vertically upwardly of the pivotal axis defined by the nut and bolt arrangement 144, the lever arm 155 is preferably located in the same horizontal plane as the pivotal axis defined by the nut and bolt arrangement 144. This arrangement assures the maximum arcuate travel for the shelf 145 in response to the minimal axial displacement of the actuating mechanism 156 which acts against the lever arm 155.

The actuating mechanism 156 which displaces the lever arm 155 may conveniently comprise a displacement shaft 158 that is interconnected to the lever arm 155 by virtue of a lost motion arrangement. Specifically, the displacement shaft 158 may include a cap screw 159 that penetrates a threaded grommet 160 secured within a vertical bore 161 through a transverse base plate 162 in the wider portion of the housing body 51. In addition, the displacement shaft 158 includes a bar 157 that is non rotatively secured to the end of the cap screw 159. The reduced diameter tang 163 on the upper end of the bar 157 extends through a connector bore 165 in the lever arm 155 to be fixedly secured within a head piece 164. When the displacement shaft 158 is turned such that the cap screw 159 is displaced downwardly through the threaded grommet 160, the bar 157 and head piece 164 move downwardly therewith to permit the lever arm 155 to rotate the pedestal clockwise as viewed in FIG. 6. Conversely, when the displacement shaft 158 is turned such that the cap screw 159 is displaced upwardly through the threaded grommet 160, the end of the displacement shaft 158 engages the lever arm 155 to rotate the pedestal counterclockwise as viewed in FIG. 6.

As will hereinafter be discussed in conjunction with the operation of the line projector 10, the combined rotational movements of the pedestals 140 effect the translational and skewing movement of the incandescent lamp 100. First, however, it should be appreciated that in order to achieve controlled, infinitesimal movement of the lamp 100, and filament 122, in immediate response to any movement of the actuating mechanism 156, one must obviate the "slop" inherent not only to movement effected by threaded connections but also to the operation of lost motion arrangement. In the exemplary embodiment depicted, this result can be achieved by stretching a relatively firm, tension spring 166 between the lever arm 155 and the base plate 162.

The narrow leg in the T-shaped body portion 51 of the housing 12 comprises a barrel 170 that terminates at its lowermost end in a lens mount 171. One or more lenses 172 are carried in the mount 171, and a focusing control 173 is employed to extend, or retract, the lens mount 171 relative to the barrel 170 in order to focus the image of the filament 122 onto the work surface 16, as is well known to the art. As is also well know to the art, the interior of the barrel 170 may be provided with the necessary baffles, not shown, to prevent undesirable reflections off the interior of the barrel 170 from being projected onto the work surface 16 in addition to the image of the filament 122. Such baffles have proven to be highly desirable even though the interior of the barrel 170 may be painted a non-reflective black. Ghost images of the filament 122 which can arise by reflection thereof off the glass envelope 125 itself can also be obviated by the use of a narrow frosted strip 175 that extends the full length of the glass envelope 125, but only along the uppermost surface thereof.

OPERATION

A line projector 10 embodying the concepts of the present invention may be selectively movable longitudinally along the supporting beam 18 from which it is presented in one of several ways to achieve an approximate, or in gross, location of the projector.

For example it is certainly possible to employ a beam 18 without a spindle 30, in which situation the housing 12 could be secured at approximately the desired location by virtue of an arrangement such as the fixed connector assembly 52. Then, too, is is also quite feasible to employ the carriage type connector 70 in conjunction with the threaded spindle 30 to effect the desired in gross adjustment of a spaced pair of projectors. In this regard it is certainly possible to employ a spindle 30 having two threaded portions 46 and 48 of opposite hand in order to effect an opposed, but balanced, movement of two, spaced line projectors 10B and 10C. It is, of course, also quite feasible to employ individual spindle sections, or a plurality of separate spindles 30 in a series of laterally adjacent beams 18, so that adjustment of one spindle would effect the desired in gross movement to just one projector at a time.

In any event, even though the aforesaid in gross adjustment might possibly achieve the exactly desired longitudinal location of a given projector along its supporting beam 18, the image of filament 122 might not properly lie along the desired track on the work surface 16 nor even provide the desired crisp image of the filament 122 on the work surface 16. This can occur as a result of the fact that the supporting beam 18 might not be properly disposed relative to the work surface 16, or because the connection between the housing 12 and the supporting beam 18 does not properly orient the housing 12. But even though all the mechanical connections might accurately dispose the lamp housing 12 relative to the work surface 16, there is never any assurance that the filament 122 is disposed within the lamp 100 with any consistency from lamp to lamp. And yet, in order to achieve a crisp, clear image with the maximum depth of field it is absolutely imperative that the filament be disposed such that the image be projected exactly perpendicularly to the reference axis 15 of the work surface 16.

The required disposition of the lamp filament 122 relative to the work surface 16 can be readily and easily achieved as a result of the novel mechanism by which the lamp 100 is supported within the housing 12. Specifically with reference to FIG. 10, the two pedestals 140 can be rotated in combination to translate the filament 122 laterally of itself, and thus correspondingly translate the image thereof along the work surface 16. On the other hand, the pedestals 140 can be rotated individually, to a greater or lesser degree, one with respect to the other, to skew the image of the filament upon the work surface 16, as desired or required.

As such, a line projector embodying the concepts of the present invention permits accurate adjustment of the filament image with comparative ease and otherwise accomplishes the objects of the invention.

What is claimed:

1. A device for projecting a vane of light onto a work surface, said device comprising:

a housing;

means to support said housing in spaced relation relative to the work surface;

a lamp;

said lamp having a linear filament, the image of which is to be projected upon the work surface;

means demountably to secure said lamp within said housing; and, means selectively to translate and/or skew said lamp filament relative to said housing.

2. A device for projecting a vane of light onto a work surface, as set forth in claim 1, wherein said lamp comprises:

a pair of spaced bases;

said linear filament extending between, and operatively connected to, said spaced pair of bases; and, a glass envelope surrounding said filament, said envelope also extending between, and being sealed to, said spaced bases.

3. A device for projecting a vane of light onto a work surface, as set forth in claim 2, wherein:

a linear portion of said envelope is frosted.

4. A device for projecting a vane of light onto a work surface, as set forth in claim 3, wherein:

said means demountably to secure said lamp within said housing is not only operably associated with said spaced bases but is also capable of accommodating any variation in distance between the bases and said securing means when said lamp is skewed.

5. A device for projecting a vane of light onto a work surface, as set forth in claim 4, wherein said means selectively to translate and/or skew said lamp comprises:

a pedestal for mounting each base of said lamp;

means for mounting each said pedestal from said housing about a pivotal axis that is disposed generally parallel to said lamp; and, means individually to pivot at least one of said pedestals about said axis.

6. A device for projecting a vane of light onto a work surface, as set forth in claim 5, wherein:

a support ball is secured to each said pedestal;

a clip is secured to each base of said lamp; and, each said clip is demountably attachable to one of said support balls.

7. A device for projecting a vane of light onto a work surface, as set forth in claim 6, wherein:

at least one said clip incorporates means to accommodate longitudinal extension and retraction thereof relative to the lamp base to which it is attached.

8. A device for projecting a vane of light onto a work surface, as set forth in claim 1, wherein said means selectively to translate and/or skew said lamp comprises:

a pedestal for mounting each base of said lamp;

means for mounting each said pedestal from said housing about a pivotal axis that is disposed generally parallel to said lamp; and, means individually to pivot at least one of said pedestals about said axis.

9. A device for projecting a vane of light onto a work surface, as set forth in claim 8, wherein said pedestal comprises:

a frame plate, said frame plate being pivotally mounted to said housing;

a shelf extending transversely outwardly of said frame plate;

one of said lamp bases being operably attached to said shelf;

a lever arm presented from said frame plate; and, said means to pivot said pedestal being operatively connected to said lever arm so that adjustment thereof displaces said shelf in order to effect the desired movement of said lamp.

10. A device for projecting a vane of light onto a work surface, as set forth in claim 9, wherein;

a support ball is secured to each said pedestal;

a clip is secured to each base of said lamp; and, said clip is demountably attachable to said support ball.

11. A device for projecting a vane of light onto a work surface, as set forth in claim 10, wherein:

at least one said clip incorporates means to accommodate longitudinal extension and retraction thereof relative to the lamp base to which it is attached.

12. A device for projecting a vane of light onto a work surface, as set forth in claim 10, wherein:

each said clip means electrically communicates with the base from which it is presented.

13. A device for projecting a vane of light onto a work surface, as set forth in claim 12, wherein said housing comprises:

a body portion;

a cap portion;

each said pedestal being mounted to said body portion of the housing;

electric terminal means presented from said cap portion; and, contact means electrically communicating between said terminal means and said support ball.

14. A device for projecting a vane of light onto a work surface, as set forth in claim 1, wherein:

said housing comprises a body portion and a cap portion;

the means to support said housing is presented from said cap portion; and, the lamp is demountably secured within said body portion.

15. A device for projecting a vane of light onto a work surface, as set forth in claim 14, wherein:

a quick connect mechanism demountably secures the body portion of the housing to said cap portion.

16. A device for projecting a vane of light onto a work surface, as set forth in claim 15, wherein said quick connect mechanism comprises:

a bracket pivotally mounted on said cap portion;

a lock bolt supported from said bracket;

a locking recess presented from the body portion of said housing;

said lock bolt selectively receivable within said locking recess; and, adjusting means selectively to translate said lock bolt releasably to secure said lock bolt within said locking recess.

17. A device for projecting a vane of light onto a work surface, as set forth in claim 14, further comprising:

at least one supporting beam; and, a connector assembly whereby to secure said cap portion of the housing to said support beam.

18. A device for projecting a vane of light onto a work surface, as set forth in claim 17, wherein said connector assembly comprises:

a carriage connector that is selectively positionable along said support beam.

19. A device for projecting a vane of light onto a work surface, as set forth in claim 18, wherein:

a spindle is rotatably mounted longitudinally within said support beam;

at least one threaded portion is presented from said spindle;

a follower block is presented from said carriage connector;

thread means are presented from said follower block, said thread means presented from said follower block matingly engaging a threaded portion on said spindle such that rotation of said spindle moves the cap portion of said housing longitudinally along said support beam.

20. A device for projecting a vane of light onto a work surface, as set forth in claim 19, wherein:

stabilizing means are provided to secure said cap portion at a selected location along said support beam.

21. A device for projecting a vane of light onto a work surface, as set forth in claim 17, wherein:

a plurality of supporting beams may be laterally stacked to present a supporting truss.

22. A device for projecting a vane of light onto a work surface, as set forth in claim 21, wherein:

a locating rib extends longitudinally along one side of at least one of said laterally stacked beams;

a locating recess extends longitudinally along one side of at least another of said laterally stacked beams in opposition to said locating rib on an adjacent beam, said locating rib being received within said locating recess to conjoin said beams into a composite truss arrangement.

* * * * *